US007665253B1

(12) United States Patent
Thompson

(10) Patent No.: US 7,665,253 B1
(45) Date of Patent: Feb. 23, 2010

(54) RETROFIT HURRICANE-EARTHQUAKE CONNECTOR

(76) Inventor: Thomas C Thompson, 92-543 Kokole Pl., Makakilo, HI (US) 96707

( * ) Notice: Subject to any disclaimer, the term of this patent is extended or adjusted under 35 U.S.C. 154(b) by 852 days.

(21) Appl. No.: 10/742,140

(22) Filed: Jul. 26, 2004

(51) Int. Cl.

| | |
|---|---|
| ***E04B 1/98*** | (2006.01) |
| ***E04H 9/02*** | (2006.01) |
| ***E04B 7/04*** | (2006.01) |
| ***E04H 17/22*** | (2006.01) |
| ***E04B 1/38*** | (2006.01) |
| ***E04C 5/00*** | (2006.01) |

(52) U.S. Cl. ..... 52/167.1; 52/92.1; 52/153; 52/702; 52/706

(58) Field of Classification Search ..... 52/167.1, 52/92.1–93.2, 698, 702, 153, 704, 706, 272, 52/289, 154, 253, 513, 703, 712; 248/300, 248/228.3, 228.5; 403/230, 187, 167, 384
See application file for complete search history.

(56) References Cited

U.S. PATENT DOCUMENTS

| | | | | | |
|---|---|---|---|---|---|
| 789,894 | A * | 5/1905 | Williams | 267/52 |
| 828,616 | A * | 8/1906 | Louden | 403/394 |
| 3,450,427 | A * | 6/1969 | Fischer | 52/513 |
| 4,592,186 | A * | 6/1986 | Braginetz | 52/699 |
| 5,205,690 | A * | 4/1993 | Roth | 411/82 |
| 5,297,890 | A | 3/1994 | Commins | |
| 5,311,708 | A * | 5/1994 | Frye | 52/90.1 |
| 5,384,993 | A * | 1/1995 | Phillips | 52/92.2 |
| 5,670,076 | A * | 9/1997 | Leek | 249/53 M |
| 5,687,535 | A * | 11/1997 | Rohlf | 52/713 |
| 5,687,938 | A * | 11/1997 | Bailey | 248/74.1 |
| 5,720,571 | A * | 2/1998 | Frobosilo et al. | 403/403 |
| 5,762,436 | A * | 6/1998 | Mosdal | 403/3 |
| 5,846,018 | A * | 12/1998 | Frobosilo et al. | 403/403 |
| 6,213,679 | B1 * | 4/2001 | Frobosilo et al. | 403/403 |
| 6,397,535 | B1 * | 6/2002 | Kim et al. | 52/250 |
| 6,763,634 | B1 * | 7/2004 | Thompson | 52/92.2 |
| 6,886,799 | B2 * | 5/2005 | Yamanashi | 248/610 |
| 6,925,772 | B1 * | 8/2005 | Iwakawa | 52/713 |
| 6,931,799 | B2 * | 8/2005 | Webb | 52/167.1 |
| 7,162,837 | B1 * | 1/2007 | Roth | 52/120 |

* cited by examiner

*Primary Examiner*—Richard E Chilcot, Jr.
*Assistant Examiner*—Andrew J Triggs

(57) ABSTRACT

A true retrofit hurricane and earthquake clip for connecting the roof to the outside wall. The metal connector includes a base member with formed pockets that form tunnels. The base member has attaching means to outside sheathing and the underlying top plate of a wall. Threaded rods from the roof are inserted through the tunnels of the base member and tightened together. The invention can be installed on different structural members of a house including a rafter, hip rafter, valley rafter, and facia board. The connector inhibits uplift, detachment, outward thrusting, twisting, and lateral movement, thereby preventing wind and seismic damage to a building.

18 Claims, 16 Drawing Sheets

RETROFIT HURRICANE-EARTHQUAKE CONNECTOR

BACKGROUND

1. Field of Invention

This invention is related to my co-pending application Ser. No. 09/810,751, in that both inventions can use a U-bolt to tie down a roof against high winds and seismic events. This invention is an innovative retrofit connector that permanently connects the roof to the wall to create buildings that are stronger and more resistant to hurricanes and earthquakes.

2. Description of Prior Art

Background

Recent studies of hurricane damage on wood-frame buildings indicate that extensive damage was generated to a house by strong winds, when the roof rafters or roof trusses twisted or were torn from the outside wall.

Roof sheathing ties all the rafters or purlins together on a wood frame house, and the roof sheathing ties all the roof trusses together when a masonry or wood-frame house is constructed with trusses. If the rafters or trusses rack or twist from the wind forces, or lift from the wall, the roof sheathing can detach from the roof allowing rain to enter the house.

Sheathing that is tightly secured to the rafters or trusses and subsequently fastened to the walls, helps transfer uplifting forces to the walls and henceforth to the foundation. The leading edge of a roof is the weakest point of sheathing uplift during strong winds, and this invention helps prevent any roof uplift.

Failure of the outside wall sheathing is common during hurricanes, because of inadequate fastening of the sheathing to the underlying structural members. This invention helps prevent the wall sheathing from splitting, racking, and detaching from the wall, as the wall and roof are held tightly together. The extreme negative pressure of a hurricane blows out the sheathing from walls, but this invention holds the sheathing tight to the walls, as metal joints are known to perform better than nailed joints in high winds and during seismic activity.

Hurricanes

Studies of damage after Hurricane Andrew show several problems with the attachment of roof rafters and roof trusses that this invention solves.

Roof overhangs act like wings, creating huge uplifting forces during strong winds. This uplift tears apart the rafters that are toe-nailed to the header or top plate. The uplift can also twist rafters and roof trusses weakening the toenailed connections and causing detachment.

The one thing that ties together the top plate, studs, and sill plate is the outside sheathing. This invention effectively ties together the roof, rafter, top plate, and outside wall sheathing to form a continuous load-path to the sill plate. Attaching my invention to the roof and top plate junction puts the fasteners perpendicular to the uplifting force and would require shearing the nails in order to lift the rafter or truss.

One significant factor in building construction is precision framing, where the rafter is installed directly above the stud. Unfortunately, in existing houses this is rarely the case.

Post-and-beam construction is very common in older homes in mild-weather areas, and we have found that the wall studs, or in this case, posts, are only under every fourth rafter, and the rafters can be 4-feet on center. Usually, the posts are directly under where the top plate butts up against the top plate in the run. The rafter is to one side of this butt joint, so the rafter does not line up directly over the post.

On newer stud-wall construction, we have seen that studs rarely line up directly under the rafters. We saw houses where the walls have studs 16-inches on center, constructed with a roof that had rafters 24-inches on center. This means the only rafter and stud that will line up to form a continuous load-path is every fourth stud or every other rafter. The odds are low that they will exactly line up.

Another problem with home construction is on mis-installation of prior art hurricane clips that are made for new construction and covered by wall sheathing. After Hurricane Andrew, there were many examples of careless and inferior attachment of hurricane clips or they were entirely missing. One company has visited new construction sites and documented many examples of shoddy and incorrect application of their products.

To achieve a continuous load-path on existing houses the outside sheathing must be taken into account. The most important tie in an existing house is between the rafter and top plate or roof truss and top plate. Any uplifting wind force on the roof must be transferred to the walls.

This invention effectively ties together the roof, rafter or roof truss, top plate, and outside sheathing (and indirectly, the wall studs) to form the most practical and economical continuous load path from the roof to the foundation.

Earthquakes

During an earthquake, the floor, wall, and roof diaphragms undergo shearing and bending. Because of the difference in weight, a roof can move at different speeds than the walls. The shear forces from the roof boundary members are transferred to the top of the shear wall by way of toenails to the top plate. To withstand and transfer the shear loads, the connection between the roof and wall must be strong.

The outside sheathing provides lateral stability to the walls, preventing racking. The sheathing also absorbs and transfers earthquake forces by becoming a shear wall.

An earthquake can send motion into a house and separate the sheathing from the walls. The sheathing can come loose from the walls by the nails popping out or the plywood splitting away from the nails driven on it's edge. Some codes allow sheathing to be stapled to the wall studs, which is a weak connection. This invention helps prevent the outside sheathing from pulling away from the wall during earth movements.

If the roof is attached securely to the roof rafter, and the roof rafter is securely attached to the outside wall sheathing and underlying top plate, the building will move as one unit rather than several different units. This invention ties the roof securely to the wall.

Steel connectors, between different components of a wood-frame buildings superstructure, provide continuity so that the building will move as a unit in response to seismic activity. This invention ties the walls securely to the roof, so the house will move as one unit.

PRIOR ART

A number of connectors have been developed to tie together the structural members of a house under construction. Up until this invention, nobody had seen how to make, a retrofit connector that could tie the top of the roof to the outside wall.

My co-pending application Ser. No. 09/810,751 is a retrofit hurricane clip that uses multiple brackets and a U-bolt to tie a roof to a rafter. A great invention, but the present invention uses just one bracket and is attached to the wall instead of the rafter.

The leading manufacturer of wood construction connectors, the Simpson Strong-tie Company, shows no retrofit hurricane connectors in their catalog. They do have a variety of connectors for use in new construction that ties the rafter to the top plate including: H1, H2, H2.5, H3, H4, H5, H6, H10, H7, H15, H10-2, and HS24. None tie the wall sheathing to the wall, and none tie the roof sheathing to the rafter and wall.

There are a number of ties that fasten the rafter to the top plate while a house is being constructed including: Knoth U.S. Pat. No. 5,561,949, McDonald U.S. Pat. No. 5,560,156, Colonias U.S. Pat. No. 5,380,115, Stuart U.S. Pat. No. 5,335,469, Callies U.S. Pat. No. 5,230,198, Colonias et al U.S. Pat. No. 5,109,646, Commins U.S. Pat. No. 4,714,372, Gilb U.S. Pat. No. 4,572,695, Gilb et al U.S. Pat. No. 4,410,294, and Maxwell et al U.S. Pat. No. 2,413,362.

These are good inventions, but they are difficult to retrofit onto existing houses without demolition of existing parts on a house. None were designed or patented to be retrofit on to an existing house.

The prior art hurricane clips provide little lateral strength, even when using a left and right. The prior art cannot tie the outside sheathing to the underlying top plate and roof rafter. They cannot tie the roof or roof sheathing to the wall.

The prior art inventions do not prevent the outside sheathing from splintering and disconnecting during earth tremors. They do not have multiple uses such as tying the roof sheathing to the rafter and top plate at the leading edge of the roof, which is the weakest point in a wood-frame house in a hurricane or tornado.

Frye's anchor system, U.S. Pat. No. 5,311,708, is patented as a retrofit, but it does not tie the rafter to the top plate, cannot clear frieze boards, and ties into the weakest thin edge of the rafter while splitting it with bolts. Frye's 708 also provides no lateral support against side movements.

Netek's reinforcing tie, U.S. Pat. No. 5,257,483, is patented as a retrofit and may clear frieze boards, but it is temporary, and like Frye, ties into an even weaker thin edge of the end of the rafter. Netek's 483 also provides no lateral support against side movements.

There are several retrofit apparatuses for securing roofs using cables. Adams U.S. Pat. No. 5,570,545 and Winger U.S. Pat. No. 5,319,896 are both temporary, meaning a homeowner must be home to deploy and anchor the ephemeral cables. The anchors can only be as secure as the nearby soil and the cables do not prevent the walls from bowing or blowing out.

There are a number of joist hangers that fasten to a joist and vertical member while a house is being constructed including: Colonias et al U.S. Pat. No. 5,104,252 and Gilb U.S. Pat. No. 4,480,941. These are good inventions, but they provide little lateral strength, and they are difficult to retrofit onto existing houses.

Joist hangers have a small ledge that supports all the weight from the joist beam. They hang the weight from the edge, rather than supporting the weight on top of the edge. They are also thin and parallel to the long dimension of the joist beam, concentrating all that carrying weight onto a vertical thin-section of the vertical member.

Gilb's complicated hanger, U.S. Pat. No. 4,261,155, is strong, but cannot be retrofit on to a house.

Commins' wood-to-pipe connector, U.S. Pat. No. 5,297,890, has a flat plate for attachment to wood frames, a semi-circular clamp for attachment to pipes, and a screw for tightening the clamp against the pipe. A great invention, but it cannot be used to tie down a roof.

Some prior art connectors relied on angled nailing, to provide lateral support, which is complex to manufacture, and very difficult to install on a completed house.

OBJECTS AND ADVANTAGES

Accordingly, several objects and advantages of my invention are that it helps secure the roof and wall of a building to make the building a solid unit and preventing it from being destroyed by hurricanes and earthquakes.

This invention helps prevent the roof from being blown off the walls of an existing building. It keeps the roof rafters and roof trusses tightly secured to the outside sheathing and underlying top plate of the wall.

This invention helps prevent the roof rafters and roof trusses from twisting during strong winds, thereby preventing detaching of the roof material and underlying roof sheathing. It stiffens the edge of the roof and the top of the wall, helping to transfer lateral loads to the whole roof and walls.

This invention helps prevent the wall sheathing of a building from detaching from the wall studs during an earthquake. It helps make the outside wall into a stable shear-wall, transferring shear forces into the foundation and ground.

One object of this invention is to make each outside wall on a house into a shear-wall, that is, able to transfer forces without breaking or disconnecting. By tying the outside sheathing securely to the top plate and rafter or roof truss, the plywood can reliably transfer and dissipate shear, lateral, and uplift forces to the ground.

During an earthquake or a hurricane, a building with my invention will be a sturdy unit, resisting and transferring destructive forces to the ground.

Many older homes were constructed with the best materials and by competent carpenters, but used the time-honored method of connecting the rafter to the top plate with nails driven into the edge of the rafter. This weak connection, called toe-nailing, is still in use today to hold roof trusses to the top plate. Even if prior art hurricane clips were used in construction of a house, the homeowner can't tell, and those clips don't hold the outside wall sheathing to the wall.

Mounted on the roof, my invention resists uplift, the most destructive force during a hurricane. Mounted on the wall sheathing and underlying top plate, this invention prevents the wall sheathing from being blown off or sucked out by the extreme negative pressure of a hurricane.

During an earthquake, this invention turns the roof and walls into a shear wall. The secured sheathing will absorb and dissipate earth movements, without becoming detached from the underlying structural members. It will also prevent the sheathing from sliding past each other.

This would improve the house beyond existing building codes, as sheet metal joints have been proven to perform better than nailed joints during hurricanes and earthquakes.

Another object of this invention is the large surface area. This area prevents the outside sheathing from splitting during hurricanes or earthquakes. The large surface area provides more strength in the connecting or hold-down process.

Yet another advantage of this invention is during earthquakes, nails can sometimes bend with the movements of the house, but screws often break. This invention absorbs and transmits most of the forces during an earthquake and hurricane so nails and/or screws can be used as fasteners.

Another advantage is that since the invention absorbs and transfers earthquake and hurricane forces, less nails and nailing could be used. Also, screws could be used in the invention in earthquake areas with less fear that the heads will shear off.

Still another advantage of the invention is in the ability to prevent plywood sheets from sliding past or over each other during an earthquake. Previously, only nails had to shear, but this entire connector must be sheared for the sheets to slide.

Still another advantage is that with the roof rafters and roof trusses better able to resist twisting, roof sheathing will stay firmly attached and roofing material will now have a better chance of staying on during strong winds and earth movements. In addition, with the sheathing now firmly connected, new materials may be attached to the roof, such as solar electric panels, without fear of them being blown off. This invention can tie these articles securely to around the rafter, whereas before they were just screwed to the sheathing or thin edge of the rafter.

In areas with brush or forest fire danger, fire-proof material or heavy material, such as tile, stone or metal, can now be applied to the roof with less danger of being blown or shaken off during earth tremors or high winds. Fire-proof materials such as stucco or brick veneer can be applied to the wall or soffit with less chance of being shaken off during earth movements.

Earth tremors and hurricanes always destroy the weakest parts of a house. By making each envelope of a house, the vertical walls and roof envelope into a strong unit, there will be less damage.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical. All of the embodiments can be made from a single sheet metal blank, without any welding.

A further object is that this invention can be used on various size sheathing, rafters, roof trusses, studs, wood or metal I-beams, TJI, and glue-lams, all made from wood or metal. There may be insurance discounts for homeowners who have this invention installed on their houses.

As a retrofit, a handy homeowner can install this invention, or have it installed. The homeowner can easily see that the home is protected instead of wondering if hurricane clips were installed correctly during construction, or installed at all.

Traditional toe-nailing of the rafter is at the bird's-mouth, a notch cut into the rafter where it rests on the top plate. By cutting out material from the rafter, a bird's-mouth weakens the rafter. Toe-nailing only two nails from either side grasps only a small edge of the rafter, and the nail only extends into the top 2× of the top plate.

Tests were done by the Colorado School of Mines on my retrofit hurricane clip, U.S. Pat. No. 6,490,840. The tests showed that the rafter split lengthwise, due to uplifting force, but the clips did not fail.

This new retrofit invention strengthens the roof to wall connection by vastly increasing the metal and amount of material around the thickest part o of the rafter. This clip also strengthens the bird's mouth by wrapping on either side of the rafter and keeping it from splitting along the long measure.

As a retrofit, an insurance agent can observe that the home is protected and give appropriate discounts. Perspective home buyers can perceive that the building is protected, so the seller has a good selling point and can ask for a better price.

Since these clips are a retrofit, and are not covered by sheathing or gypsum board, the invention is much thicker than prior hurricane clips and tensile values are dramatically increased.

Another advantage is with the roof connected securely to the walls, this invention tremendously increases resistance to outward thrusts. This makes the roof much stronger and able to resist more weight such as thick snow, ice, or volcanic ash, and heavy roofing material such as tile, insulated roofing, solar collectors, and satellite dishes.

Since this invention cradles the rafter or roof truss on the bottom, top, and left and right side, and has a wide base anchored to the outside wall, torsional twisting of the rafter is significantly reduced over prior art hurricane clips, as is cross-grain splitting.

The invention can be attached to the roof without anyone physically being on top of the roof. One embodiment attaches to the bottom of the roof sheathing and to the pocket clip attached to the outside wall.

These and other objectives of the invention are achieved by a simple and economical connector that allows a builder or home owner to quickly and easily secure the weakest parts of a building against earth tremors and high winds. The weakest parts being the rafter to top plate connection, the leading edge of roof sheathing, and the attachment of wall sheathing.

Advantages of each will be discussed in the description. Further objects and advantages of my invention will become apparent from a consideration of the drawings and ensuing description.

REFERENCE NUMERALS IN DRAWINGS

Figure 1:
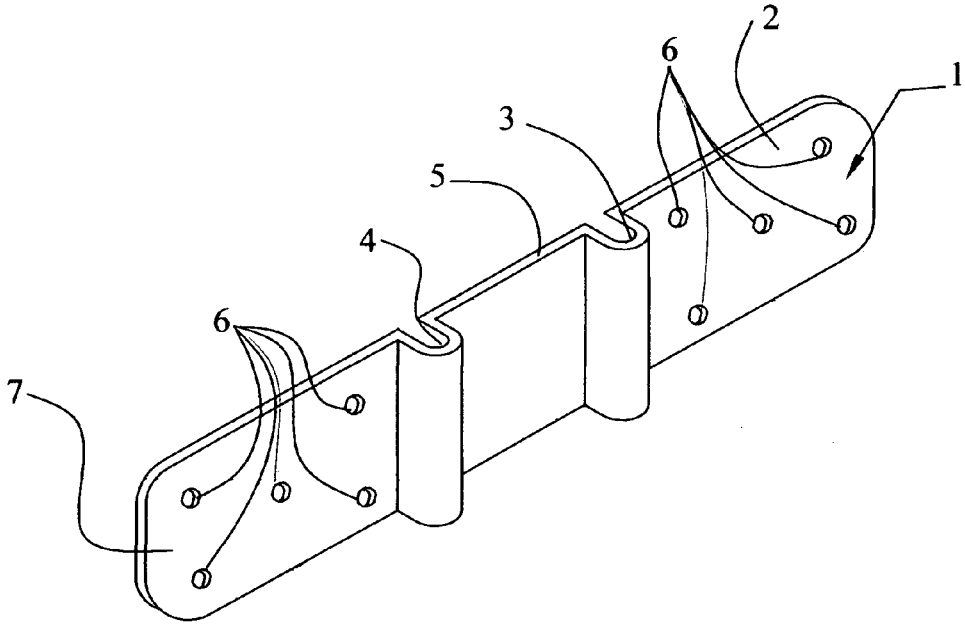
FIG. 1 is a perspective view of a pocket clip.

| | |
|---|---|
| 1. | Pocket clip |
| 2. | Right base plate |
| 3. | First tunnel |
| 4. | Second tunnel |
| 5. | Bridge plate |
| 6. | Nail holes |
| 7. | Left base plate |
| 8. | Roof plate |
| 9. | Threaded rod |
| 10A-H. | Bends |
| 11. | Nut |
| 12. | Washer |
| 13. | Bolt holes |
| 18. | Centerline |
| 19A. | Hip clip |
| 19B. | Valley clip |
| 20. | U-bolt |
| 21. | Formed clip |
| 22. | Middle section |
| 23. | Pipe |
| 24. | C-bracket |
| 25. | Sheathing tab |
| 25A. | Hole |
| 26. | Transition web |
| 27. | Curved base |
| 28. | Oblong opening |
| 29. | Lag bolt |
| 30. | Angle iron |
| 31. | Sheathing web |
| 32. | Connection web |
| 33. | Connection hole |
| 34. | Threaded spoke |
| 35. | Disk-type head |
| 36. | Threaded body |
| 37. | Nose clip |
| 38. | Top wall plate |
| 38A. | Nail hole |
| 39. | Bottom wall plate |
| 40. | Sloped web |
| 40A. | Oblong hole |
| 41. | Back web |
| 42. | Back hole |
| 43. | Right section |
| 44. | Left section |
| 45. | Nail hole |
| 46. | Right channel arch |
| 46A. | Right channel |
| 47. | Left channel arch |
| 47A. | Right channel |
| 48A-B. | Bends |
| 49A-B. | Bends |
| 50. | Left-hand base plate |
| 50A. | New right base plate |
| 50B. | New left base plate |
| 50C. | Right hand base plate |
| M. | Roofing material |
| R. | Rafter or roof truss |
| S. | Roof sheathing |
| T. | Top plate |
| W. | Wall sheathing |
| H. | Hip rafter |
| V. | Valley rafter |
| U. | Wall stud |
| AP. | Facia |

DESCRIPTION

The present invention is a retrofit connector for joining wood members on a building, such as a roof rafter R, roofing material M, underlying roof sheathing S, and outside wall sheathing W and underlying top plate T.

During a hurricane, this invention prevents the roof from disconnecting from the wall by uplifting forces. This invention prevents the outside wall from detaching from the roof due to negative pressure extremes generated by a hurricane. It also prevents the top of the wall from bowing in when on the windward side of a hurricane.

This invention prevents detachment and sliding of the outside wall from lateral forces during an earthquake. It makes the outside wall into an extremely stable shear wall, because of the secure attachment to the roof. This invention helps transfer seismic forces to the roof and to the house's other walls, and back to the foundation.

Besides these very important functions, this invention is a retrofit and is easy to install on completed houses. The U-bolt cradles the rafter R on two sides, no matter what the slope is of the roof. The U-bolt will also easily fit on rafters made up of roof trusses, glue lams, engineered wood I-beams, or metal beams. The rafter webs 7 and 8 are simple to attach to the rafter with nails or screws.

The base web 14 is easily attached to the outside sheathing W with nails or screws. The wide rafter webs 7 and 8, on either side of the rafter R provide plenty of room for hammering, hammer-gun, or electric screwdriver. If the outside walls are made of brick or masonry all the way up to the rafter, holes can be marked, drilled with a carbide drill, and inserted with lead-type anchors. Common screws can then be used to install the base web 14.

Sheet metal connectors have been proven to perform better than nailed connections under stresses of strong winds and earth tremors. This invention is very easily installed on a pre-existing house without disassembly or destruction of the house. If a soffit is located on the house, it is not structural, so it can be taken down and reinstalled when the typhoon clips are installed. Once installed, the house is much stronger than just nailed connections and more sturdy than prior art connectors that are installed during construction of a building.

The invention can be easily installed as a retrofit at the weakest connection of a house, during a hurricane, the rafter R to outside wall sheathing W and underlying top plate T. This is also a weak connection during an earthquake, as the roof is heavier than the walls and moves at a different rate which can tear the roof from the walls.

Refer now to FIG. 1, which shows a perspective view of a pocket clip 1. In the preferred form of the invention, the unitary pocket clip 1 has a rectangular right base plate 2 on the right, and a rectangular left plate base plate 7 on the left. In the middle is a flat bridge plate 5. Between the bridge plate 5 and the right base plate 2 is a first tunnel 3. Between the bridge plate 5 and the left base plate 7 is a second tunnel 4.

The first and second tunnels 3 and 4 are parallel. The right base plate 2 and left base plate 7 have nail holes 6 for attachment to structural members of a house.

Figure 2:
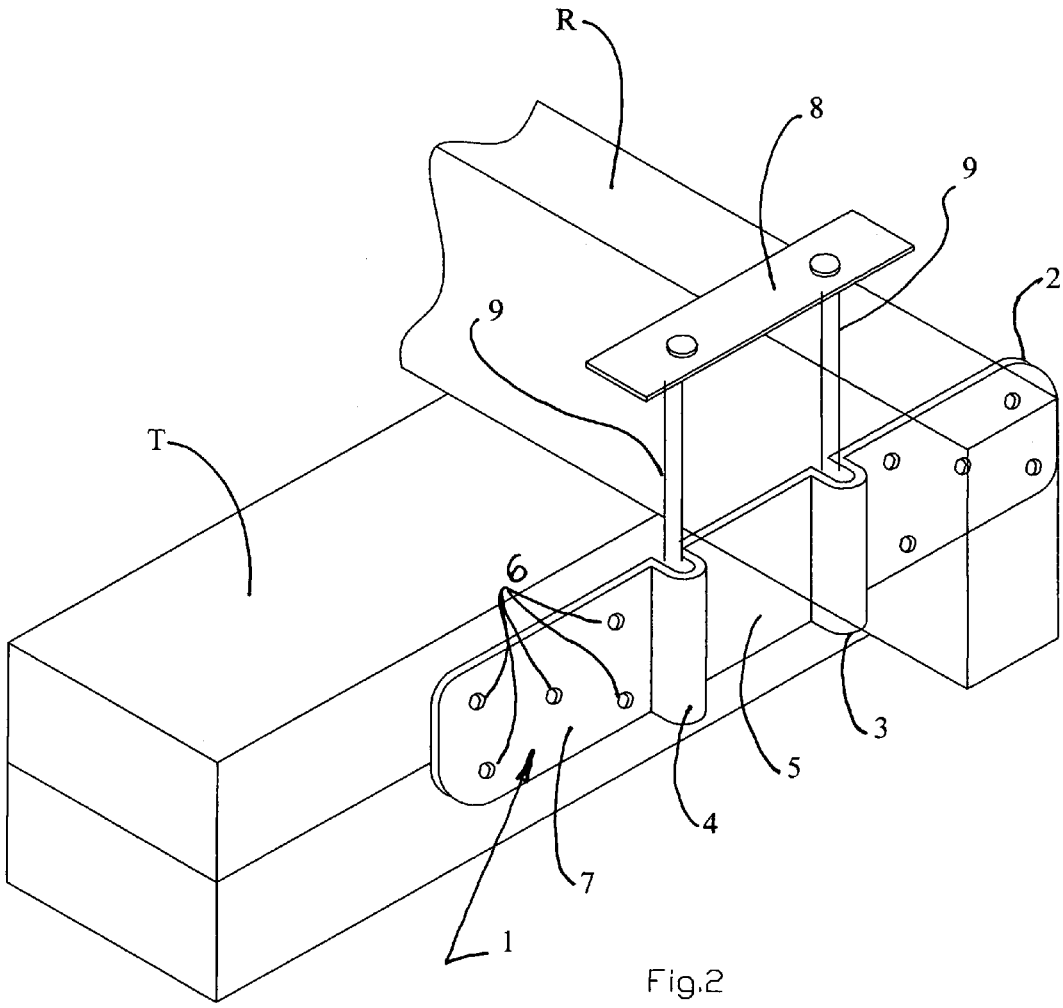
FIG. 2 is a perspective view of a pocket clip installed on a rafter and top plate.

Refer now to FIG. 2, which shows a perspective view of how a pocket clip 1 mounts to structural members on a building. The pocket clip 1 is shown attached to the sides of the top plate T by fasteners through the nail holes 6 on the left base plate 7 and right base plate 2.

The rafter R is shown positively attached to the top plate T. A roof plate 8 and threaded rods connect the rafter R to the top plate T with nuts 11 and washers 12.

Operation is simple. The pocket clip 1 is positioned on the top plate T with the bridge plate 5 under the rafter R. The pocket clip 1 is then attached to the top plate T with fasteners through nail holes 6 on the left and right base plates 7 and 2. By placing the bridge plate 5 directly under the rafter R, the first tunnel 3 will be to the right, and the second tunnel 4 will be to the left of the rafter R.

Threaded rods 9 inserted through the bolt holes 13 on the roof plate 8 pass through the first and second tunnels 3 and 4, and are secured to the pocket clip 1 with nuts 11 and washers 12. The pocket clip 1 is shown mounted on the outside wall, but can also be mounted on the inside wall of the house.

Figure 3:
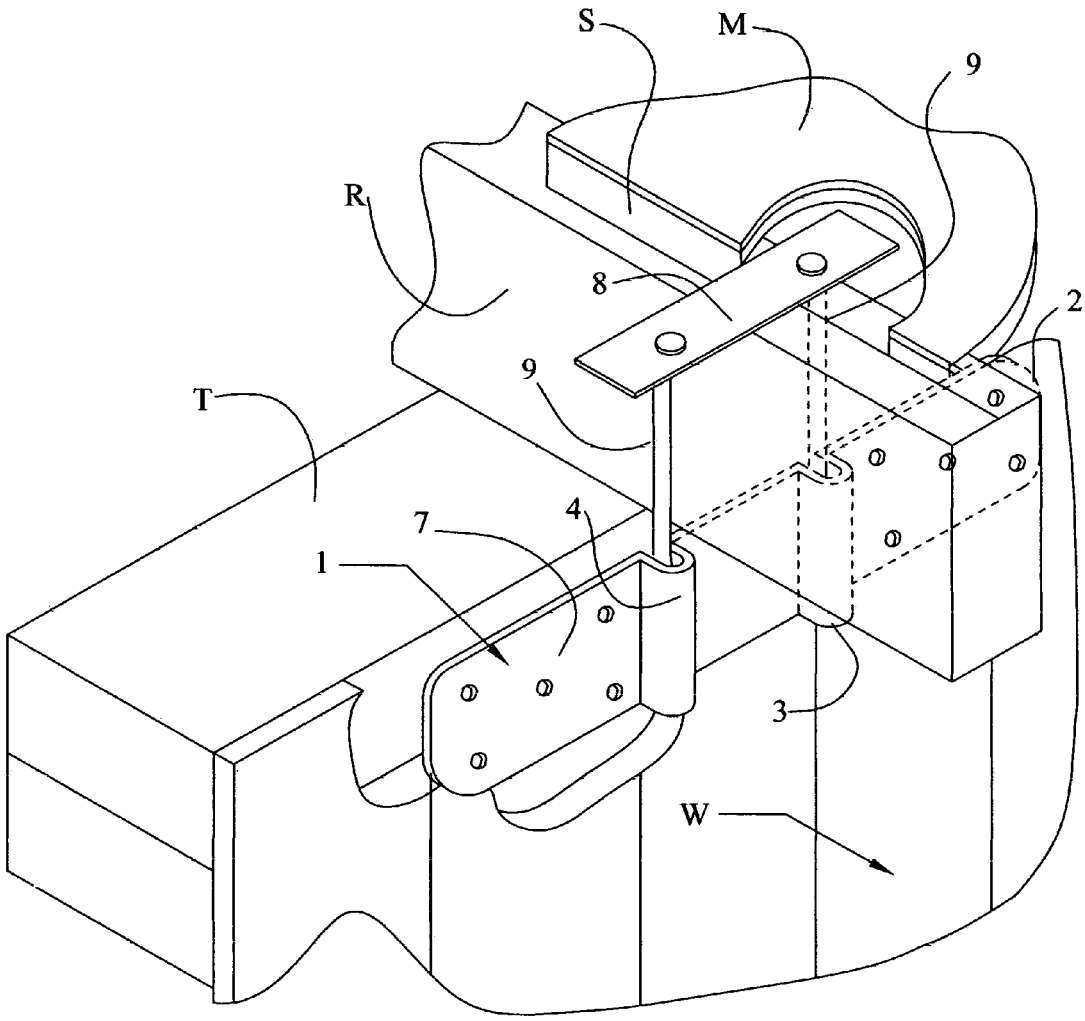
FIG. 3 is a perspective view of a pocket clip installed as a retrofit on outside wall sheathing, underlying top plate, roof rafter, roofing material, and roof sheathing.

Refer now to FIG. 3, which shows a perspective view of a pocket clip 1 mounted as a retrofit on to an existing building. The pocket clip 1 is shown tying down the roofing material M, underlying roof sheathing S, and roof rafter R to the outside wall sheathing W and underlying top plate T.

The pocket clip 1 is slid onto the outside wall sheathing W and up under a roof rafter R, so that the bridge plate 5 is directly under the rafter R. This places the first tunnel 3 on the right side of the rafter R, and the second tunnel 4 on the left side of the rafter R. The pocket clip 1 is then attached to the sheathing W and the underlying top plate T by fasteners through the nail holes 6 on the left and right base plates 2 and 7.

Holes are then drilled up through the roof, directly up from the first tunnel 3 and second tunnel 4. These holes will penetrate the roofing material M and underlying roof sheathing S. From the rooftop, a roof plate 8 is placed over the drilled holes. Threaded bolts 9 are dropped through the bolt holes 13 of the roof plate 8, through the drilled holes, and into the first and second tunnels 3 and 4 on the pocket clip 1.

The rods 9 are then tightened down to the pocket clip 1 with nuts 11. The roof is now tightly secured to the wall. Wind and pressures that try and lift the roof will be stymied. Winds and pressure that try and blow the wall out will be thwarted, as will pressure that tries to force the wall inward.

News reports of hurricanes always show corrugated roofing material blowing down a street. The pocket clip 1 can be used to tie down metal, wood, tile, composite, asphalt, fiberglass, stone or other roofs. The pocket clip 1 keeps the outer roof and outer walls from detaching from a building during strong winds.

During seismic events, the heavier roof can oscillate differently from the walls. This can cause the roof to separate from the walls and the home can collapse. The pocket clip 1 ties the roof solidly to the wall so they move together as one solid unit. Lateral movement is negated because of the horizontal length of the pocket clip 1 and the large mounting area to the left and right of the rafter. Prior hurricane ties were vertical and therefore had little area to the left or right of the rafter to prevent lateral movement.

Since the pocket clip 1 is mounted to the outside wall sheathing W, it prevents detachment and helps turn the wall into a shear wall. As a strong shear wall, the outside wall can absorb and transfer seismic forces to other walls, the roof, and to the foundation.

Figure 4:
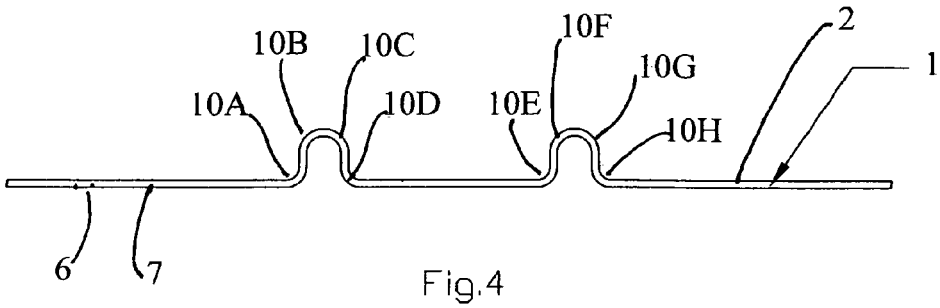
FIG. 4 is a top view of a pocket clip.

Refer now to FIG. 4 which shows a top view of a pocket clip 1. One can see how the right base plate 2, left base plate 7, and bridge plate 5 are generally flat and linear. This makes placement on to structural members of a building simple and easy.

The first tunnel 3 and second tunnel 4 are formed out from the right and left base plates 2 and 7, and the bridge plate 5 by bends 10A-H. The side of the tunnels in line with the bridge plate 5 and base plates 2 and 7 will be mostly closed off by the structural member of the house. Threaded rod will fit through the opening shown in the first and second tunnels 3 and 4.

Figure 5:
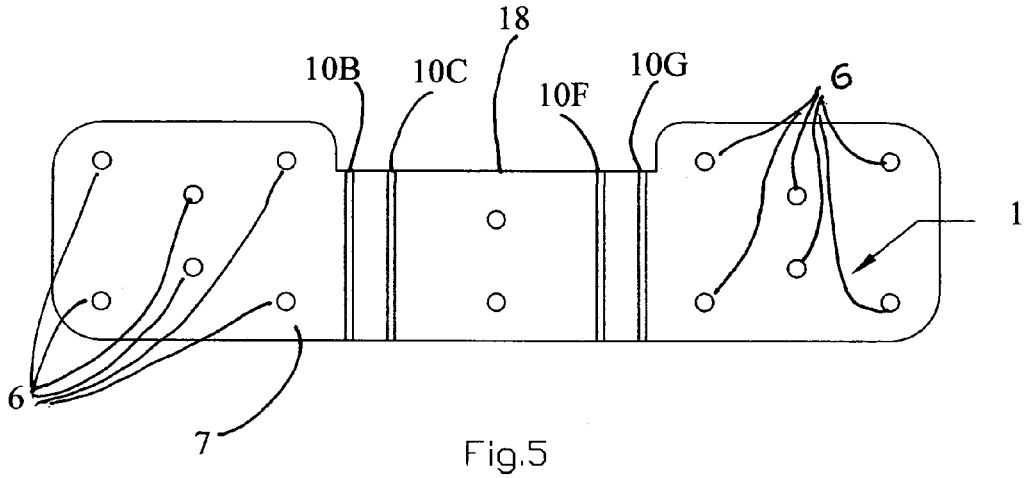
FIG. 5 is a front view of a pocket clip.

Refer now to FIG. 5 which shows a front view of a pocket clip 1. The width of the bridge plate 5 can span wood, metal, or engineered rafters and trusses. The horizontal length of the pocket clip 1 helps prevent lateral movement during seismic events.

Figure 6:
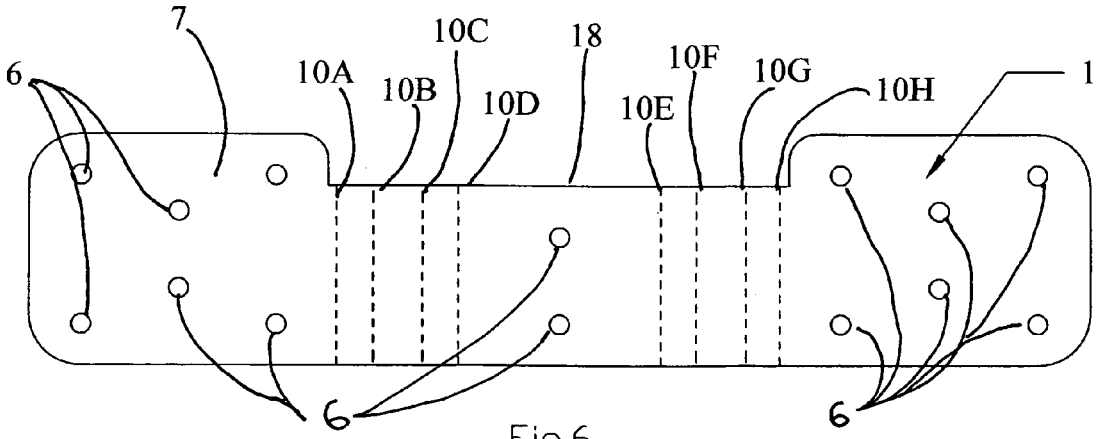
FIG. 6 is a flat pattern layout of a pocket clip.

Refer now to FIG. 6 which shows a flat pattern layout of a pocket clip 1 before bending. The tool and die maker makes the bends at the bend lines 10A-H. The bends form the first and second tunnels 3 and 4.

Besides the extreme strength that the pocket clip 1 imparts to a building, what really makes the pocket clip 1 unique is the different structural members that it can tie together. By bending the pocket clip 1 in half along the centerline 18, two different clips will be formed. By bending the right base plate 2 and left base plate 7 back so they are perpendicular to each other, a hip clip 19A is formed. It can be used to tie down the hip rafter on a hip roof. By bending the right base plate 2 and left base plate 7 forward so they are perpendicular to each other, a valley clip 19B is formed.

Figure 7A:
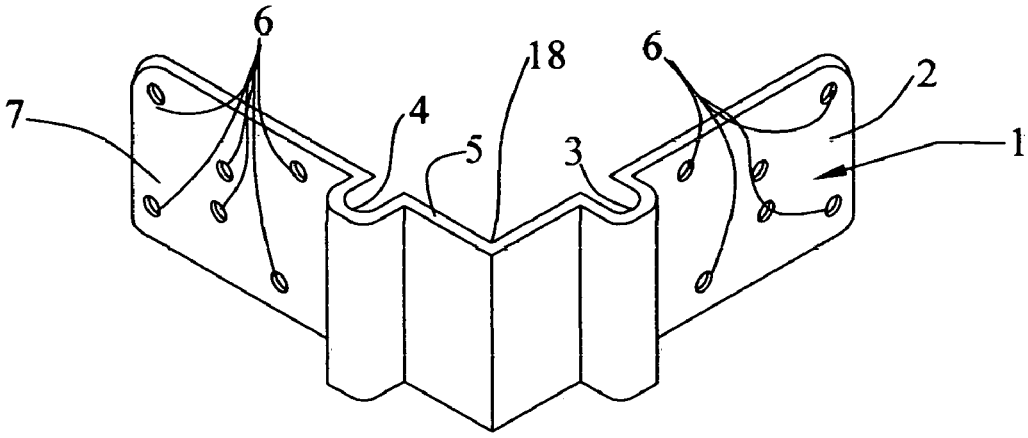
FIG. 7A is a perspective view of a hip clip.
Figure 7:
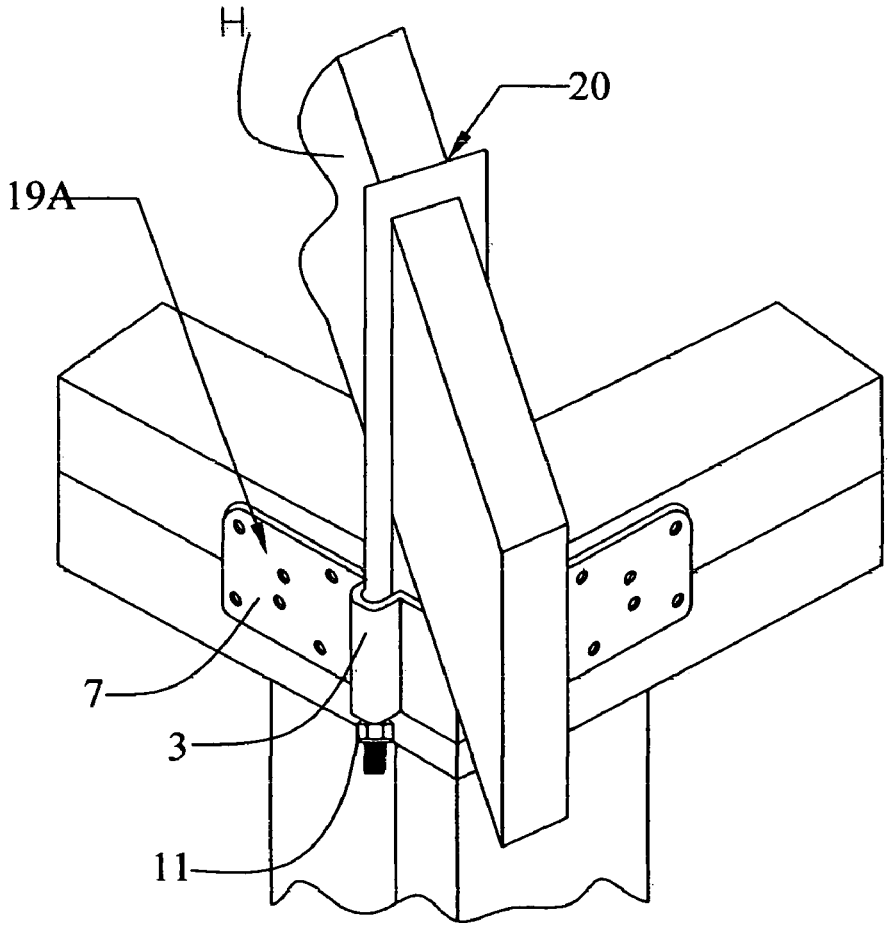
FIG. 7 is a perspective view of a hip clip mounted to a hip rafter.

Refer now to FIG. 7 which shows the hip rafter H on a roof. The roof sheathing, jack rafters, and wall sheathing are not shown so that the viewer can see how the hip clip 19A can tie down the hip rafter H. The hip rafter H is very important in the structure of a hip roof, as many other rafters are attached to it. It is usually on the corner of a house and is at an angle to the intersecting top plates T.

FIG. 7 shows a hip clip 19A attached to the top plate T on the left side of the hip rafter H. The left base plate 7 of the hip clip 19 is fastened to the top plate T with the second tunnel 4 to the left of the hip rafter H. Hidden by the hip rafter H, on the right side of the hip rafter H, the right base plate 2 of the hip clip 19A is fastened to the top plate T. If the wall sheathing were shown, the hip clip 19A would be on the sheathing W and attached to the underlying, intersecting top plates T.

A U-bolt 20 is shown wrapping over the hip rafter H and entering each respective tunnel on each side of the hip clip 19A. On the left side of the hip rafter H, a leg of the U-bolt 20 is shown in the second tunnel 4 and secured to the hip clip 19A by a washer 12 and nut 11. The same would occur on the right side of the hip rafter H into the first tunnel 3 of the hip clip 19A.

Installation of the hip clip 19A is simple. A U-bolt 20 is slid up each tunnel 3 and 4 on the hip clip 19A. The spot on the underside of each roof sheathing is marked for drilling, and each left and right base plate 2 and 7 are attached to the wall sheathing W and underlying top plate T. The U-bolt is pulled out and the holes drilled up into the roof. The U-bolt 20 is dropped down the drilled holes from the roof and into the respective tunnels 3 and 4, and tightened with nuts 11.

The roof sheathing S meets on the hip rafter H at an angle, coming from the left and right just like the top plates T. It is hard to cut correctly, and harder to nail securely to the hip rafter H. If the sheathing were shown, the left leg of the U-bolt 20 would go through the sheathing sheet on the left and the right leg would go through the sheathing sheet on the right.

The hip clip 19A effectively ties together two angled and intersecting sheets of roof sheathing, one hip rafter, two intersecting top plates, and two intersecting sheets of wall sheathing.

Refer now to FIG. 7A which shows a perspective view of the hip clip 19A. This shows how the left and right base plates 7 and 2 are bent.

Figure 7B:
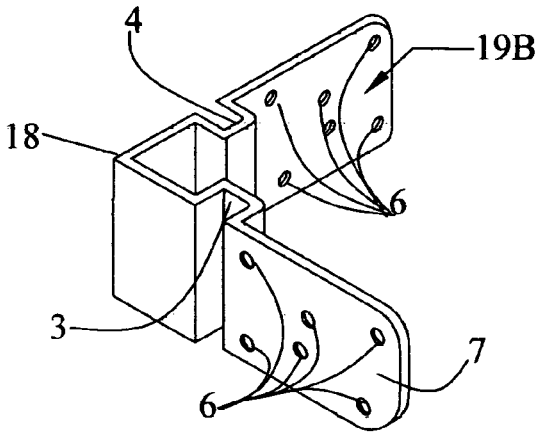
FIG. 7B is a perspective view of a valley clip.

Using the same flat pattern layout for the pocket clip 1 and hip clip 19A, the valley clip 19B can be formed by bending the left base plate 7 and right base plate 2 at the centerline 18, toward the front. Refer now to FIG. 7B which shows a perspective view of a valley clip 19B.

Figure 7C:
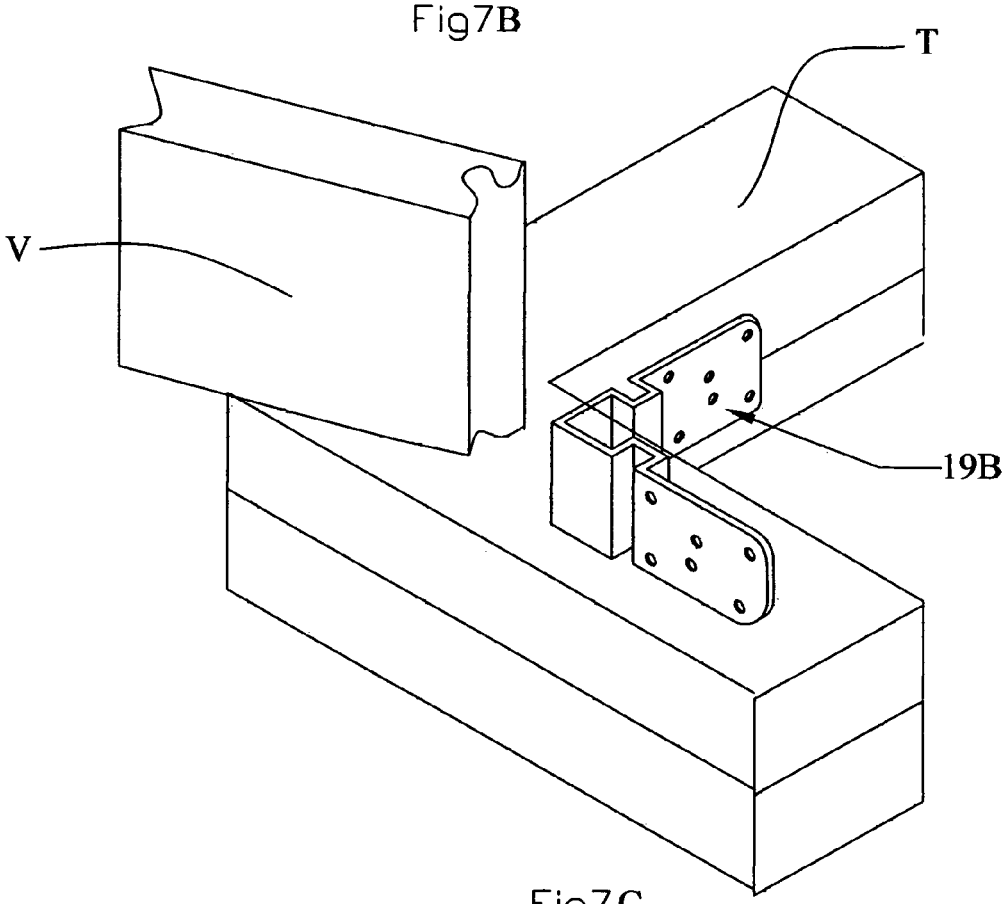
FIG. 7C is a perspective view of a valley clip installed to a valley rafter.

Refer now to FIG. 7C which shows a valley clip 19B attached to the valley rafter V. The roof sheathing S meets on the valley rafter V at an angle, coming from the left and right just like the top plates T. It is hard to cut correctly, and harder to nail securely to the valley rafter V. If the sheathing were shown, the left leg of the U-bolt 20 would go through the sheathing sheet on the left and the right leg would go through the sheathing sheet on the right. The valley clip 19B is installed similar to the hip clip 19A.

The valley clip 19B effectively ties together two angled and intersecting sheets of roof sheathing, one valley rafter, two intersecting top plates, and two intersecting sheets of wall sheathing. Numerous jack rafters are attached to the hip rafter and valley rafter, so it is important to tie them securely to the wall.

The reason no one sells a retrofit connector to strengthen houses is because there is a wide variety of house styles, and it is difficult to retrofit a connector that can fit on everyone of them. The present invention is unique because it can fit on numerous structural members on different styles of buildings.

Figure 8:
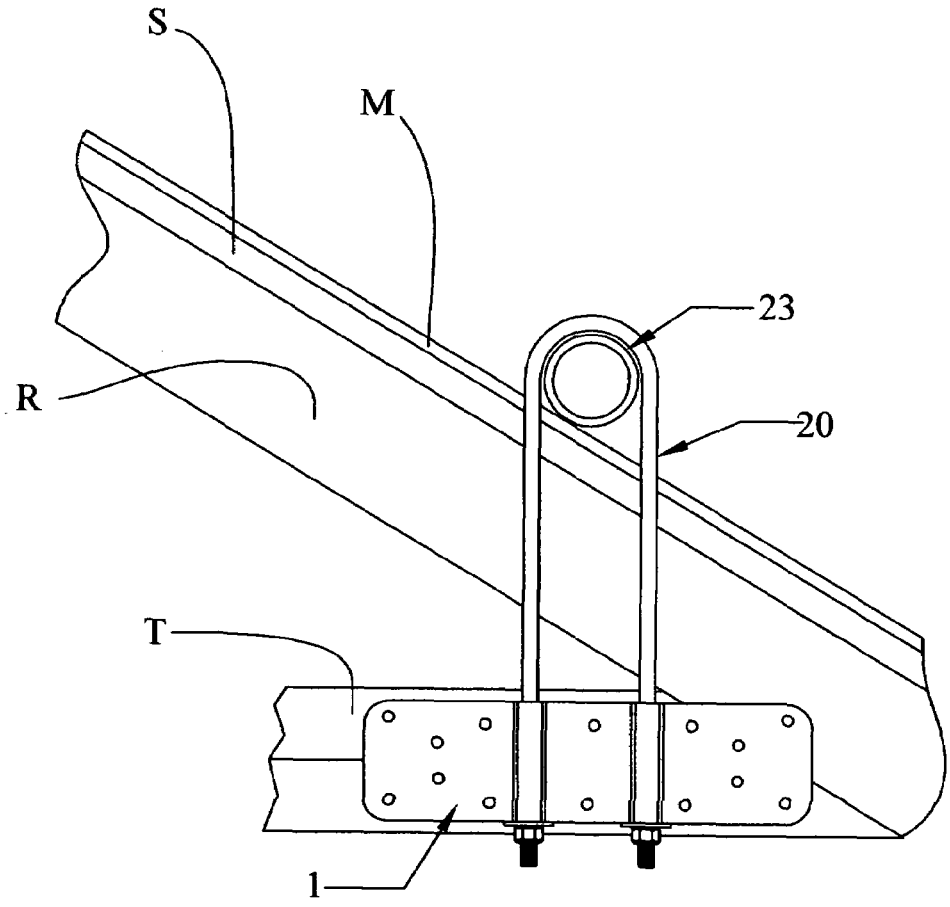
FIG. 8 is a side view of a pocket clip attached to the gable end of a house.

Refer now to FIG. 8 which shows a pocket clip 1 installed on the gable end of a house. Many houses are built using hip style roofs, gable style roof, or a combination of them. The pocket clip 1 fits on the rafters and trusses that are normally perpendicular to the top plate (FIG. 2), which are found on most types of homes. The hip clip 19A fits on the hip rafter (FIG. 7), and the valley clip 19B fits on the valley rafter. FIG. 8 shows how the pocket clip 1 ties down the roof at the gable end.

The sheathing is not shown so that the viewer can see how the pocket clip 1 attaches to the top plate T under the wall sheathing. A U-bolt 20 is attached through the tunnels of the pocket clip 1 and is shown holding down a pipe 23 against the roof sheathing S and roof rafter R.

On the opposing gable end of the house, another pocket clip 1 and U-bolt 20 can hold down the other end of the pipe 23. This prevents the rafters R and roof sheathing S from lifting up during strong winds. It also helps prevent the weak gable end of the house from bowing in or blowing out from strong wind, and pressure from strong wind. This could be permanent or temporary, such as a historical house that needs to be protected from a hurricane, but the modern hurricane protection can not be permanent.

Steel cable could be substituted for the pipe 23 if the distance between gable ends is too long. If cable is used, it could also go through the U-bolt 20 and tie into the foundation.

The pocket clip 1 can be installed on the gable end by securing the left and right base plates 2 and 7 to the outside sheathing W and underlying top plate T. Holes can be drilled up through the roof, directly above the first and second tunnels 3 and 4. A U-bolt 20 can be inserted through the drilled holes, over the pipe 23 or cable, inserted into the tunnels 3 and 4, and secured to the pocket clip 1 by nuts 11.

Many homeowners want to secure the roof to their walls, but do not want to drill holes in the roof as they would not want leaks. The present invention places the drilled holes on the outside of the top plate, which is on the exterior of the house. There should not be any leaking into the house. But for those who would not want any holes, would not want anything showing on the roof, or would not want to get up on the roof themselves, a simple embodiment ties into the underside of the roof sheathing.

Figure 9:
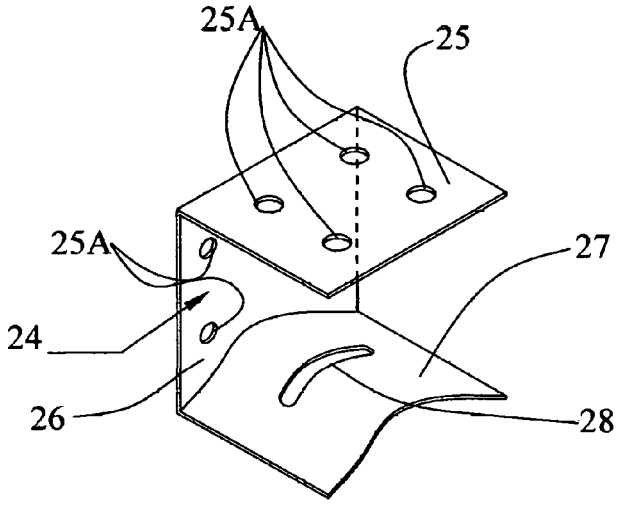
FIG. 9 is a perspective view of an C-bracket.

Refer now to FIG. 9 which shows a perspective view of a C-bracket 24. At the top, the sheathing tab 25 has holes 25A for attachment to the underside of roof sheathing S on a house. Connected to the sheathing tab 25 by a bend is the transition web 26. At the bottom of the transition web 26, connected by a bend, is the curved base 27. The curved base 27 has an oblong opening 28.

The sheathing tab 25 and curved base 27 are generally bent parallel to each other. The oblong opening 28 can accommodate a leg of the U-bolt 20 at a variety of angles. The curved base 27 is formed so that a washer 12 and the center flat of a nut 11 can tighten as a tangent against an arc of the curved base 27.

Figure 10:
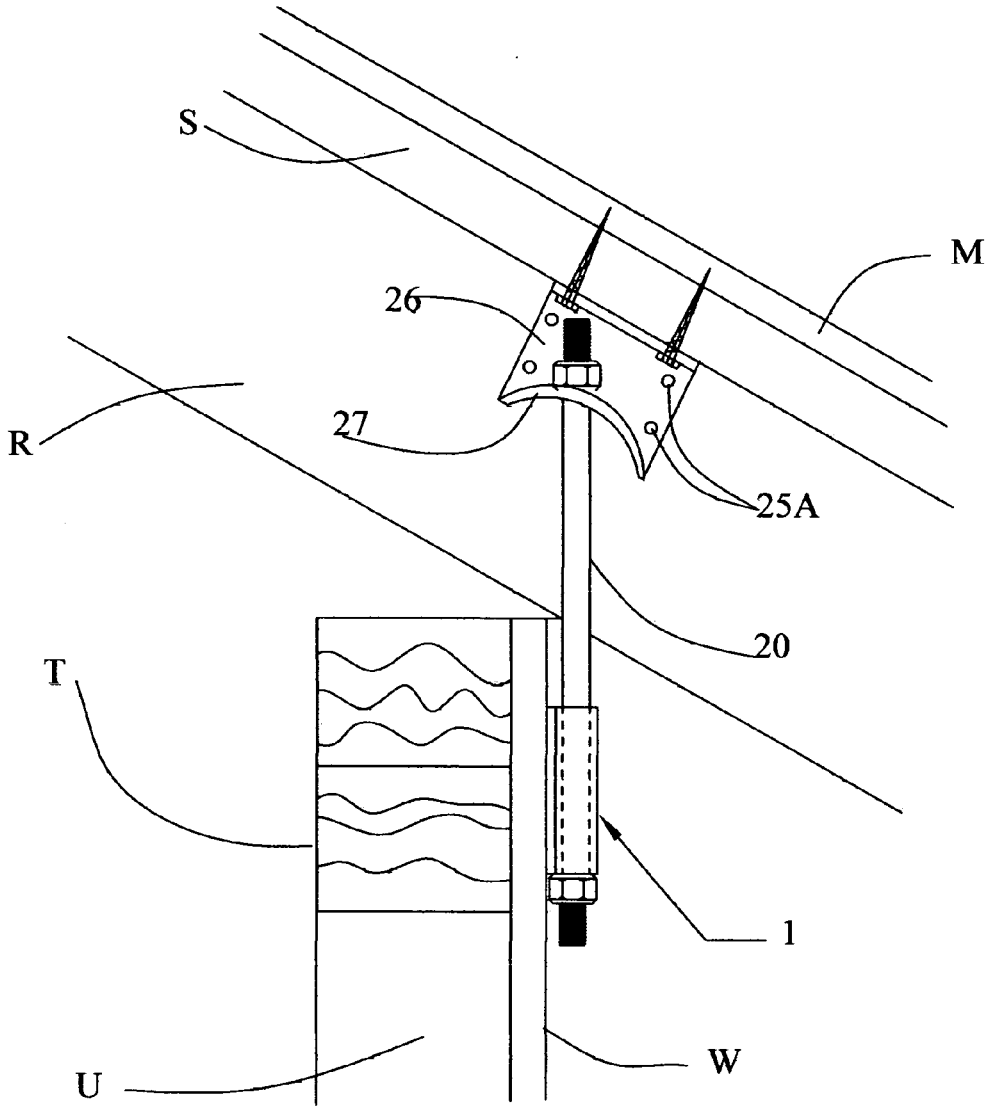
FIG. 10 is a side view of an C-bracket attached to roof sheathing, and connected to a pocket clip by a U-bolt.

Refer now to FIG. 10 which shows a side view of an C-bracket 24 mounted to the sheathing S under a roof, and connected to a pocket clip 1 by a U-bolt 20. The C-shape allows the transition web 26 to be flat against a rafter, and attached to the rafter R for greater strength.

The C-bracket 24 is shown attached to the underside of the roof sheathing S, at the sheathing tab 25, by lag bolts 29. A pocket clip 1 is shown attached to the wall sheathing W and underlying top plate T. A leg of a U-bolt 20 is inserted up through the first and second tunnels 3 and 4 of the pocket clip 1 and into each oblong opening 28 on either side of the rafter R. A nut 11 tightens against a washer 12 onto a tangent of the curved base 27. The wide surface area of the sheathing tab 25 on either side of the rafter R and number of fasteners securely ties the roof to the wall, without any holes drilled in the roof or anyone being on top of the roof.

Figure 11:
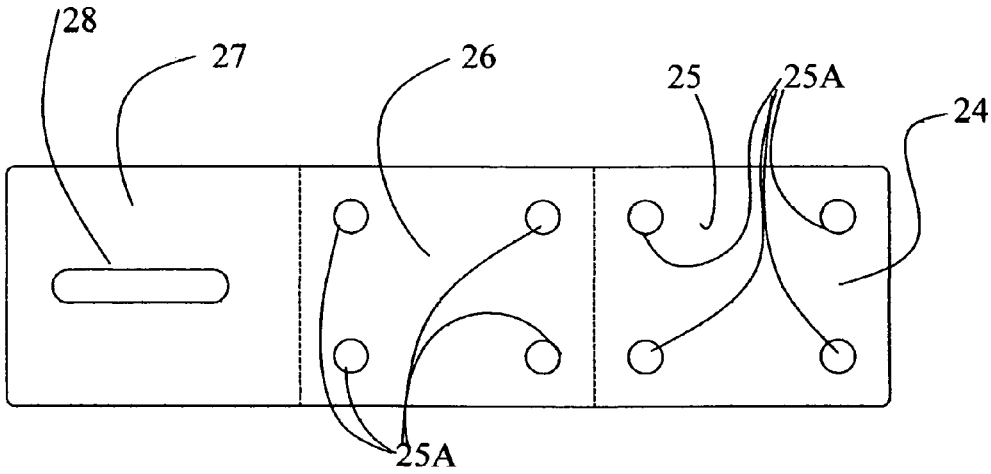
FIG. 11 is a flat pattern layout of an C-bracket.

Refer now to FIG. 11 which shows a flat pattern layout of a C-bracket 24. The holes 25A and oblong opening have been punched in, but the bends between the sheathing tab 25 and transition web 26, and the curved base 27 and transition web 26 have not been made. The forming of the curved base 27 has not been done.

Figure 12:
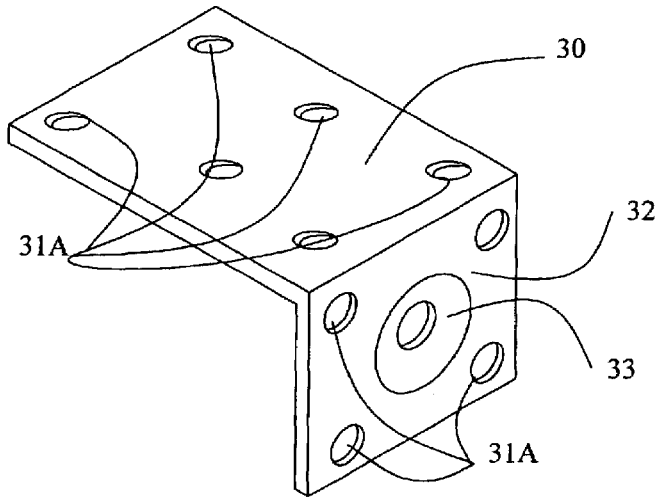
FIG. 12 is a perspective view of an angle iron.

Another embodiment that can tie down the roof sheathing without being on the roof is shown on FIG. 12. The angle iron 30 can be attached to the bottom of the roof sheathing S. The angle iron 30 has a sheathing web 31 with holes 31A for fastening to the underside of roof sheathing S. A perpendicular bend on the sheathing web 31 forms a connection web 32. The connection web has a hole 33 for connecting a threaded spoke 34, and holes for attachment to a rafter R.

Figure 12A:
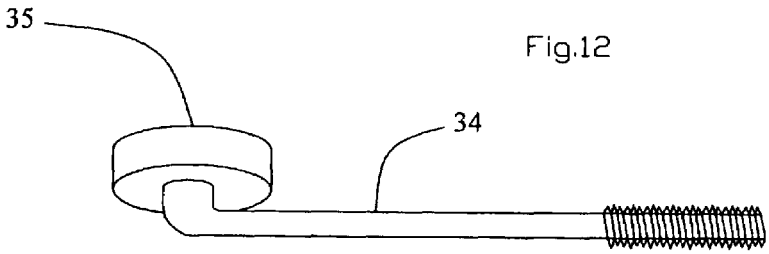
FIG. 12A is a side view of a threaded spoke.
Figure 12D:
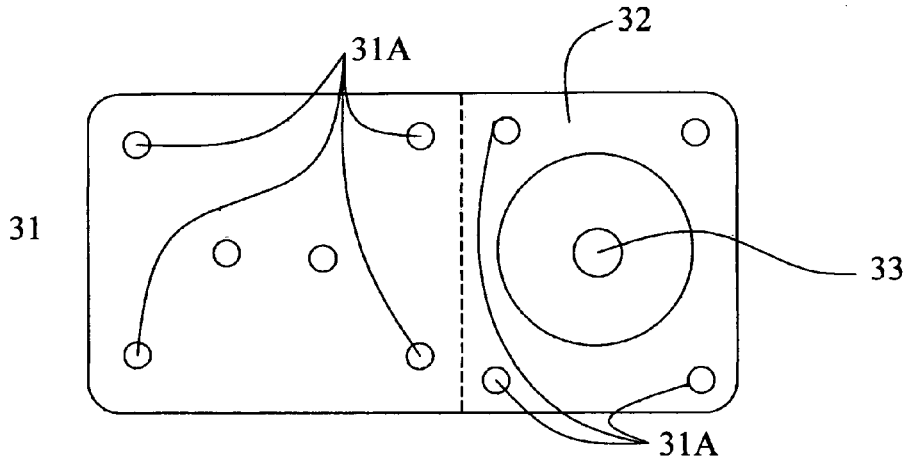
FIG. 12D is a flat pattern layout of an angle iron.
Figure 12C:
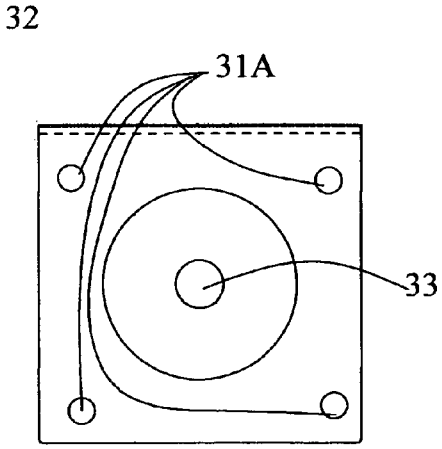
FIG. 12C is a front view of an angle iron.
Figure 12B:
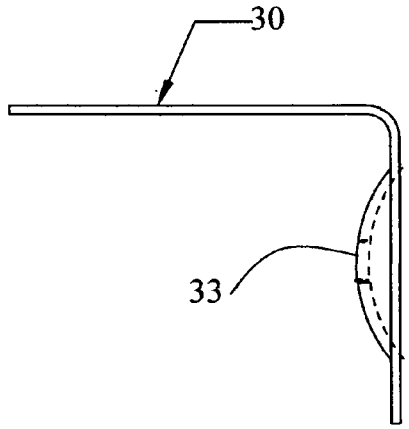
FIG. 12B is a side view of an angle iron.

Refer now to FIG. 12A which shows a side view of a threaded spoke 34. The threaded spoke looks like a large threaded nail with the head of the nail bent over at a right angle. The head is a disk-type head 35. The disk-type head 35 is larger than the connection hole 33 on the angle iron 30. The threaded body 36 of the threaded spoke 34 fits through the connection hole 33 and the right angle bend at the disk-type head 35 can hinge in the connection hole 33.

Figure 13:
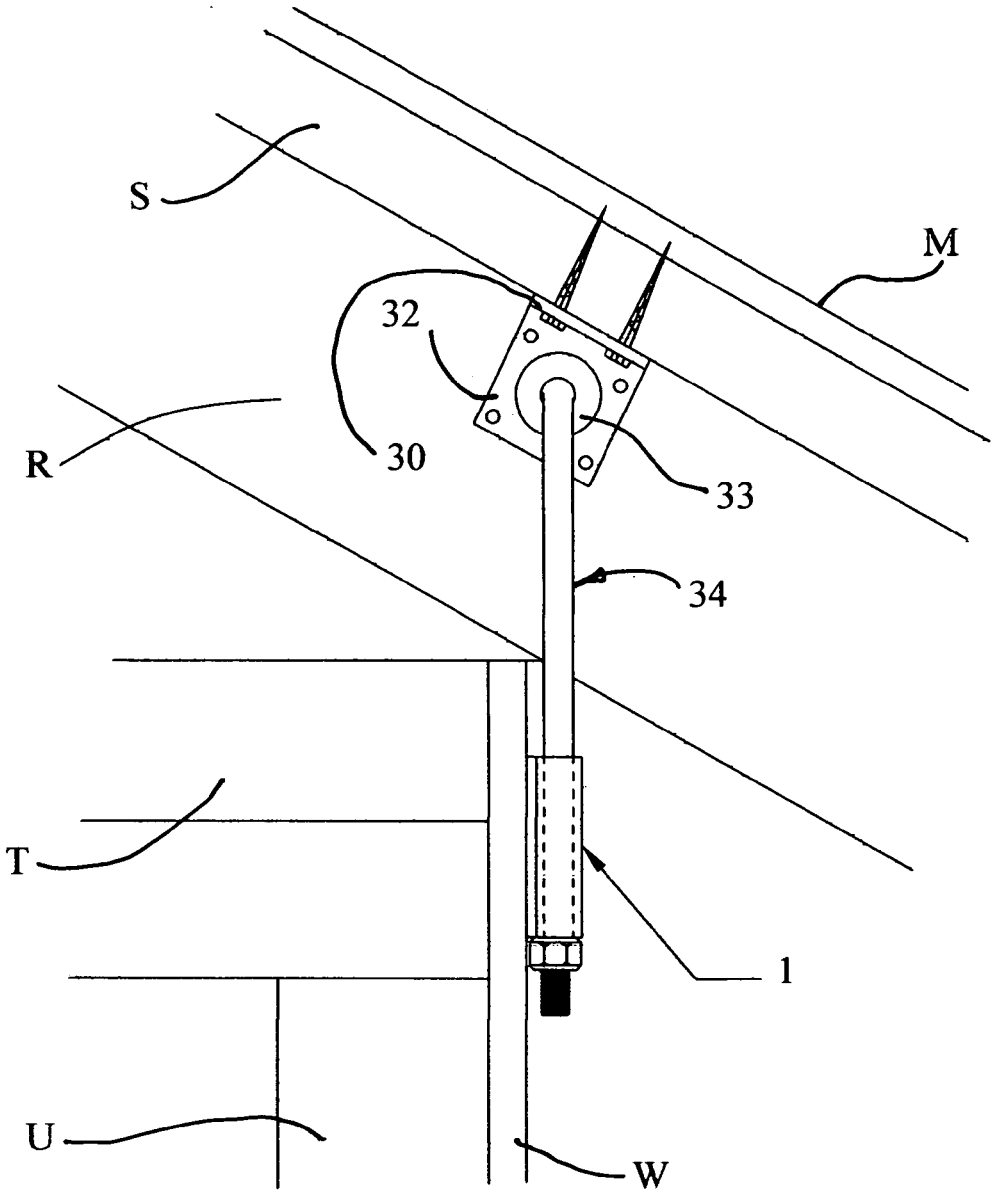
FIG. 13 is a side view of an angle iron attached to roof sheathing, and connected to a pocket clip by a threaded spoke.

Refer now to FIG. 13 which shows a side view of an angle iron 30 attached to roof sheathing S, and connected by a threaded spoke 34 to a pocket clip 1. The threaded body 36 of the threaded spoke 34 is inserted into the connection hole 33 on the angle iron 30, so the disk-type head 35 is flush against the outer part of the angle iron 30.

The angle iron 30 is fastened to the underside of the roof sheathing S by lag bolts 29 through holes 31A on the sheathing web 31. While the connection web 32 is fastened to the rafter R with fasteners through nail holes. The threaded spoke 34 is hanging down in preparation for insertion through a tunnel on the pocket clip 1. The same would occur on the other side of the rafter R.

A pocket clip 1 has a threaded spoke 34 from each side of the rafter inserted into each tunnel 3 and 4, and the pocket clip 1 is attached to the wall sheathing W and underlying top plate T, underneath a rafter R, by fasteners. Connecting the angle iron 30 to the pocket clip 1 are the threaded spokes 34. The flat head of the disk-type head 35, allows it to be flush against the rafter R, and the right angle bend in the connection hole 33 allows the threaded spoke 34 to hinge for fitment against any slope of roof. A nut 11 tightens the threaded spoke 34 through each tunnel 3 and 4 of the pocket clip 1.

Although the pocket clip 1 shown on FIG. 1 is the preferred embodiment, other embodiments may receive the threaded rods 9, or legs of a threaded U-bolt 20, or threaded spoke 34.

Figure 14:
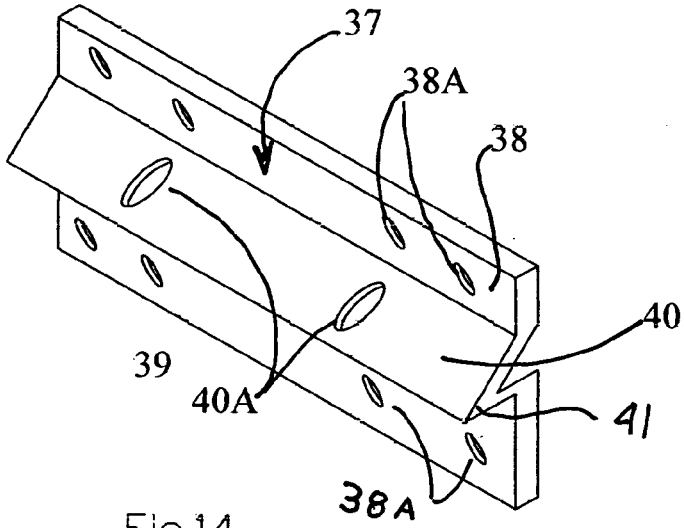
FIG. 14 is a perspective view of a nose clip.

Refer now to FIG. 14 which shows a nose clip 37. From the side, the nose clip 37 has the profile of a nose. The nose clip 37 has a top wall plate 38 and a bend at the bottom that forms a sloped web 40. A sharp angle at the bottom of the sloped web 40 forms a back web 41. A right angle forms a bottom wall plate 39. The top wall plate 38 and bottom wall plate 39 are in the same plane.

The top wall plate 38 and bottom wall plate 39 have nail holes 38A for attachment to wall sheathing W and underlying top plate T. The nose clip 37 is placed under a rafter R, similar to a pocket clip 1, and threaded rods 9 are placed down from the roof into each oblong hole 40A on the sloped web 40. The threaded rods 9 also go through back holes 42 (not shown in this view) on the back web 41. The back holes 42 on the back web 41 are directly below the oblong holes 40A on the sloped web 40. Nuts 11 can screw up on to the threaded rods 9 from below and would lie flat with a washer 12 against the bottom of the back web 41.

Figure 15:
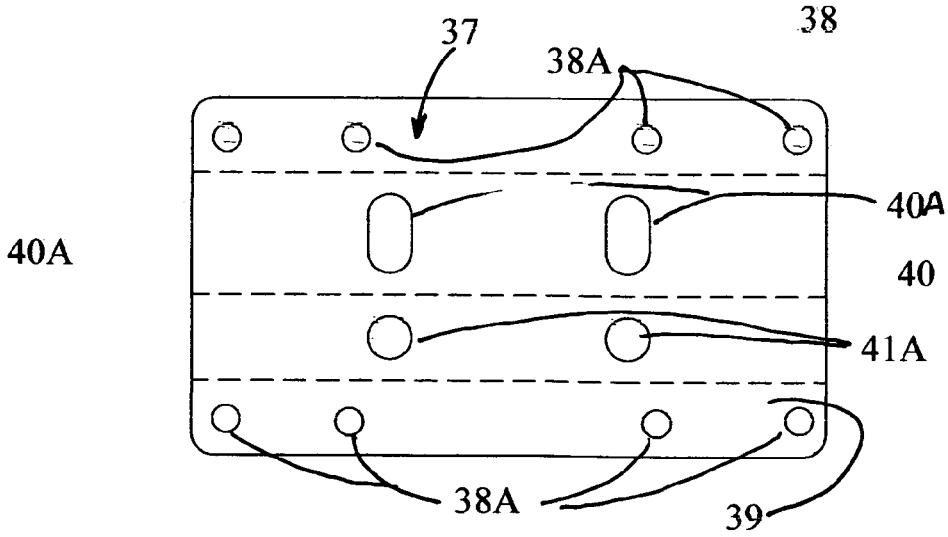
FIG. 15 is a flat pattern layout of a nose clip.

Refer now to FIG. 15 which is a flat pattern layout of a nose clip 37. The top wall plate 38 is at the top. To the bottom is a bend line and the sloped web 40 is next. On the bottom is a bend line and the back web 41. On the bottom is the bottom wall plate 39. The oblong holes 40A and the back holes 42 on the back web 41 will line up when the nose clip 37 is bent into shape by standard tool and die methods.

Figure 16:
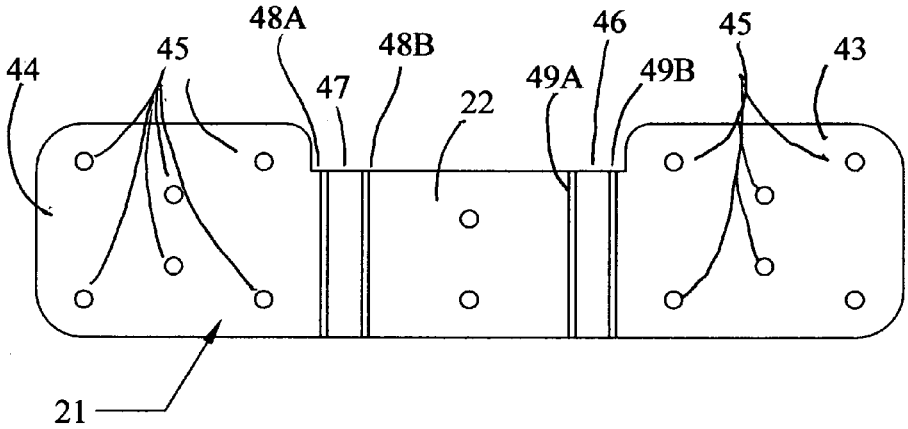
FIG. 16 is a front view of a formed clip.
Figure 16A:
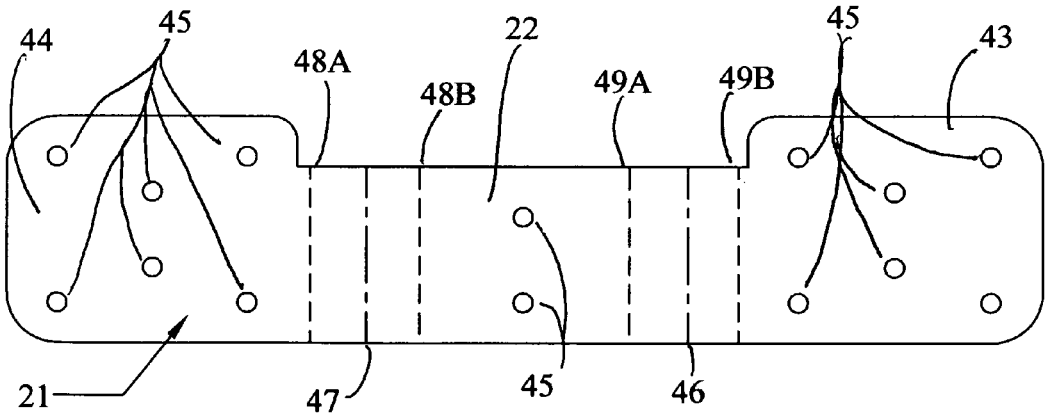

Refer now to FIG. 16 which is a front view of a formed clip 21. The formed clip 21 is similar to a pocket clip 1 except the bends forming the tunnels are formed, not bent. The formed clip 21 has a middle section 22 that is placed under a rafter. On the right side is the right section 43 that has nail holes 45. Between the middle section 22 and right section 43 is a right channel arch 46. A smoothly-formed bend 49B is between the right section 43 and right channel arch 46. Another smoothly-formed bend 49A is between the middle section 22 and right channel arch 46.

On the left side is the left section 44 that has nail holes 45. Between the middle section 22 and left section 44 is a left channel arch 47. A smoothly-formed bend 48A is between the left section 44 and left channel arch 47. Another smoothly-formed bend 49B is between the middle section 22 and left channel arch 47.

Figure 17:
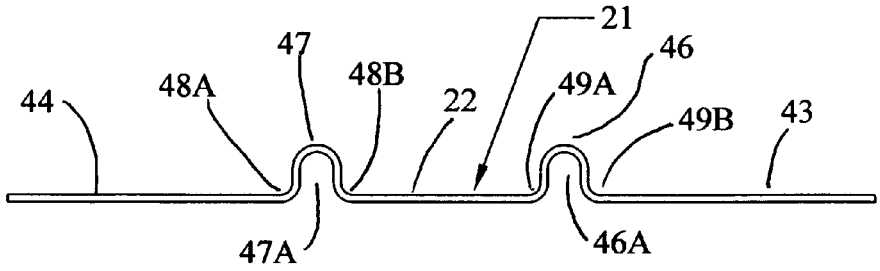
FIG. 17 is a top view of a formed clip.

Refer now to FIG. 17 which shows a top view of a formed clip 21. It can be seen more clearly how the bends are formed smoothly from the metal. Smooth forming of the metal strengthens and work hardens the metal. The formed clip 21 is formed by standard tool and die methods from a rectangular blank, like the pocket clip 1.

Figure 18:
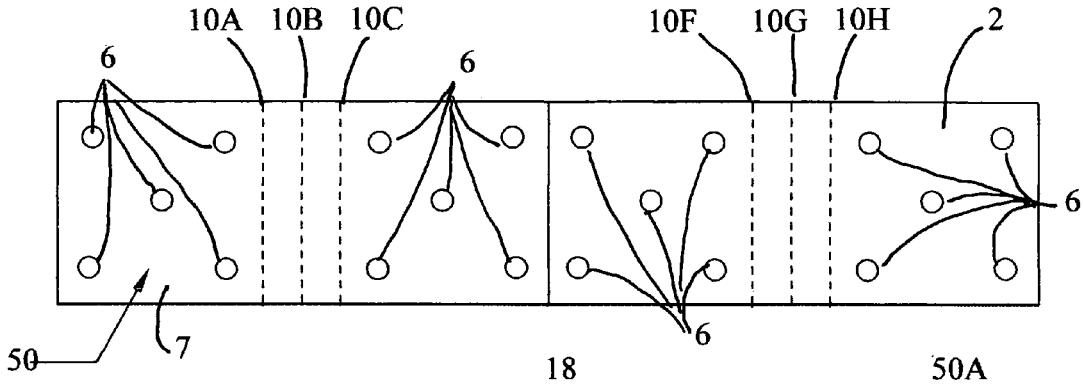
FIG. 18 is a flat pattern layout of a first facia clip and second facia clip.

Refer now to FIG. 18 which is a flat pattern layout of a first facia clip 50 and second facia clip 50A. The flat pattern layout is the same as the pocket clip 1, hip clip 19A, and valley clip 19B. Instead of bending at the centerline 18, as done on the hip clip and valley clip, the centerline 18 is cut. Two bend lines on the pocket clip are not bent. The innermost bends 10D and 10E (from FIG. 6) are not bent, and nail holes are punched into the new left base plate 50B and new right base plate 50C.

By cutting at the centerline 18, two mirror image clips are formed. A first facia clip 50 will be formed on the left, and a second facia clip 50A will be formed on the right.

Figure 19:
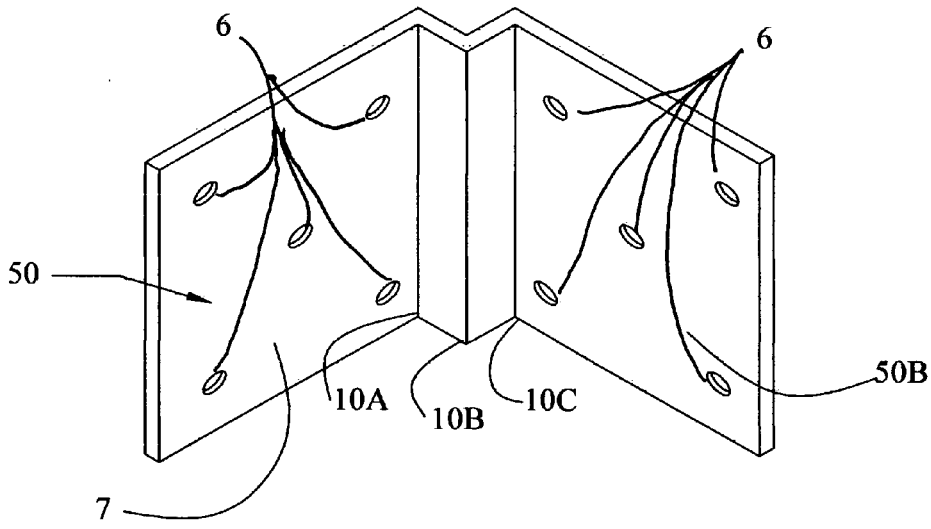
FIG. 19 is a perspective view of a first facia clip.

Refer now to FIG. 19 which shows a perspective view of a first facia clip 50. By not bending the innermost bend 10D, the new left base plate 50B is perpendicular to the left base plate 7. The three bends 10A-C, form a double L-shape. The double L-shape forms a hollow step in profile.

Figure 20:
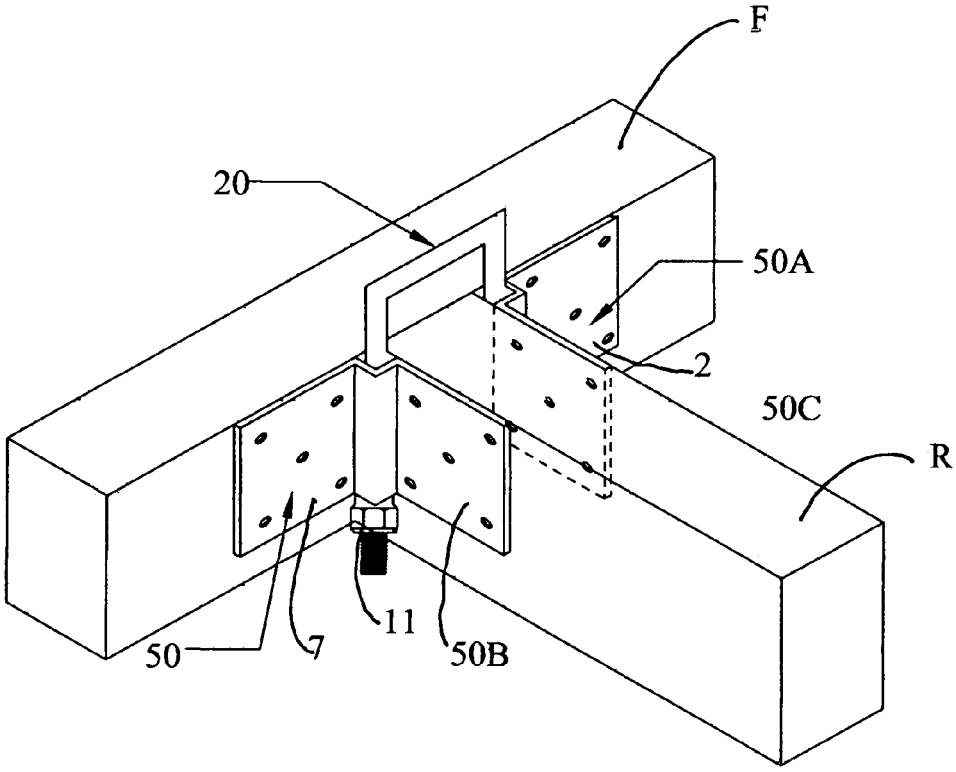
FIG. 20 is a perspective view of a first and second facia clip mounted to a building.

Refer now to FIG. 20 which shows a first facia clip 50 and second facia clip 50A attached to the facia board F and rafter R of a building. The double L-shape formed by the three bends 10A-C form a tunnel when placed against the intersecting structural members. This formed tunnel allows threaded rods to enter and be fastened with a nut. This will secure the leading edge of roof sheathing (not shown in this figure for clarity) to the facia board F and to the rafter R.

On the back side of the rafter R, a second facia clip 50A is shown fastened to the rafter R and facia board F. Installation is simple. The first facia clip 50 and second facia clip 50A are fastened to the rafter R and facia board F with fasteners. A hole is drilled up through each formed tunnel, and a U-bolt 20 is lowered from the roof, Nuts 11 and washers 12 are used to tighten down the roof sheathing to the rafter R and facia board F. The rafter, facia board, and roof sheathing are now secured tightly together. Holding down the leading edge of sheathing and preventing the facia board from detaching from the rafters will prevent the roof from lifting or twisting. This prevents wind and seismic damage to a building.

CONCLUSION, RAMIFICATIONS, AND SCOPE OF INVENTION

Four retrofit hurricane and earthquake connectors can be formed from the same flat pattern layout. A pocket clip, hip clip, valley clip, and facia clip. The pocket clip is a true retrofit connector that helps protect a house from the effects of hurricanes and earthquakes. The clip holds the roof securely to the outside wall. While prior hurricane clips tied the rafter to the top plate, none tied the roofing material and roof sheathing to the outside wall sheathing and underlying top plate.

The pocket clip helps prevent a roof rafter from lifting, twisting, moving in toward the house, moving out from the house, moving to the left, and moving to the right. It also secures the roofing material and roof sheathing. The pocket clip also helps prevent the outside wall sheathing from bowing out, bowing in, separating from the wall, riding over each other, and splitting. The pocket clip turns the outside wall into a strong shear-wall and prevents the wall from racking.

The pocket clip can be installed on different structural members of a house. It can be installed on the roof, roof rafter, outside wall sheathing, and underlying top plate. It can be installed on the gable wall of a house and tied to another gable wall. Embodiments can also be installed on the hip rafter, valley rafter, and facia board of a house.

The threaded rods that tie into the pocket clip can be U-bolts, standard bolts, or cables. Each tying down an important structural member of a house.

Thus the reader can see that the hurricane and seismic connector of this invention is unique, strong, permanent, functional, and necessary. Each embodiment is simple and economical to make, requiring a simple tool and die and no welding.

This invention solves the problem of retrofitting houses to minimize high wind and seismic dangers by using an ingenious and practical connector. Many homeowners stay in their house during hurricanes, because they do not want to be caught in traffic jams trying to escape the fury, or they live on a small island, or they are caught unaware.

While my above description contains many specificities, these should not be construed as limitations on the scope of the invention, but rather as an exemplification of one preferred embodiment thereof. Many other variations are possible.

For example, since the connectors are on the outside of a building, the shape can be changed slightly to make them more architecturally appealing on certain types of houses. To fit on some architectural styles of houses, the shape can be changed slightly without comprising the structural integrity of the clip. The thickness of the connector can be altered slightly, or have beveled edges or chamfer.

Rubber, plastic, foam, or resilient pads could be inserted between the connector and the outside sheathing. This would help absorb the earthquake forces without cracking, and deaden the shocks, and after-shocks.

The U-bolts can be round or angular. roof plates could have a rubber washer, O-ring, or silicone seal where it goes through the roof in order to make the connection water-proof. This will allow the tie to hold roof sheathing to the rafter, without letting water into the house. The tie could use this rubber to reduce loading and deaden shocks from a seismic event.

The roof plate is comprised of a generally flat steel plate. Since the steel plate will be exposed to the elements, it can be of stainless steel, or painted to match the roof. It can be copper-coated or made from strong plastics or man-made material. It can be textured to match shake shingles or have an s-curve shape or c-shape in order to fit the hills and valleys of a clay tile roof. It can have an arch in the middle in order to hold down solar panels or satellite dishes.

The roof plate can be rectangular square, or curved. A diamond-shape or a banana-shape would look pleasing from the street and will shed water when installed with the point or arch, toward the top of the house.

The invention could use different manufacturing techniques including manipulated sheet metal, casting, forging, extrusion, and plastic molds or injection. There can also be minor variations in color, size, and materials.

This invention was over-designed in order to exceed building codes in force or any that can be anticipated. Many areas have no codes for retrofit's because, prior to this invention, there were no workable ties that could be retrofit to most buildings. Lag bolts, nails, screws, or bolts and washers could be used to fasten the connectors to the house.

I claim:

1. A retrofit hurricane and earthquake connector for positively connecting the roof to the wall on a house comprising:

a. a generally flat, rectangular plate having a right side, middle, and left side;

b. separating said right side and said middle is a plurality of generally parallel bends forming a first tunnel;

c. separating said left side and said middle is a plurality of generally parallel bends forming a second tunnel;

d. each said parallel bend occurring generally on the front face of said rectangular face;

e. each axis of each said tunnel is offset from each other;

f. each said tunnel having an entrance on one end and an exit on the opposite end;

g. each said tunnel having a predetermined area for receiving a threaded rod;

h. each said right and left side having a plurality of nail holes.

2. The connector of claim 1 wherein said right side, said middle and said left side are generally in the same plane and having said tunnels on the front rectangular face, as a means for easy attachment of the generally flat, rear face on the outside wall of a building.

3. The connector of claim 1 wherein said middle having predetermined area for spacing apart each said tunnel on either side of a rafter, thereby said tunnels are generally parallel to a wide side of said rafter, when said rectangular plate is fastened on a wall below the roof rafter.

4. The connector of claim 1 wherein each said threaded rod adapted for attachment to the top of a roof through a drilled hole, or to the underside of a roof by attaching means.

5. The connector of claim 1 wherein said threaded rods adapted for fastening tightly into each said tunnel from the roof, thereby securing said roof to said wall and helping prevent uplift of the roof, which occurs during strong winds.

6. The connector of claim 1 wherein said right side and said left side of said rectangular face having predetermined area and plurality of nail holes for attachment to the wall and underlying top plate, thereby preventing lateral movement of the rafter and house, when said threaded rods are attached to said tunnels, and thereby preventing seismic damage to a building.

7. A retrofit hurricane and earthquake connector for positively connecting the roof to the wall on a house comprising:

a. a generally flat, rectangular plate having a right side, middle, and left side;

b. separating said right side and said middle is a plurality of generally parallel bends forming a first tunnel;

c. separating said left side and said middle is a plurality of generally parallel bends forming a second tunnel;

d. each said parallel bend occurring generally on the front face of said rectangular face;

e. each said tunnel having an entrance on one end and an exit on the opposite end;

f. each axis of each tunnel is parallel to each other;

g. each said tunnel having a predetermined area for receiving a threaded rod;

h. each said right and left side having a plurality of nail holes;

i. said middle having a generally right angle bend approximately in the middle, thereby placing said right side and said left side perpendicular to each other.

8. The connector of claim 7 wherein said right angle bend in the approximately middle of the middle having the axis of the bend generally parallel to the axis of each said tunnel.

9. The connector of claim 7 wherein said right angle bend bending said front face so the right side and left side are generally perpendicular and facing away from each other, thereby forming a hip clip.

10. The connector of claim 7 wherein said hip clip having attaching means to the wall and underlying top plate, underneath and to either side of the hip rafter of a house, whereby said left side and said right side are attached to intersecting structural members.

11. The connector of claim 7 wherein an upper part of said threaded rods adapted for attachment to a roof and a lower part adapted for insertion into each said tunnel, when said connector is attached to the intersecting walls below a hip rafter.

12. The connector of claim 7 wherein said threaded rods adapted for fastening tightly to each said tunnel, thereby securing said hip rafter to said intersecting walls and thereby helping prevent uplift of the roof which occurs during strong winds.

13. The connector of claim 7 wherein said right side and said left side having predetermined area and a plurality of nail holes for attachment to the intersecting walls and underlying, intersecting top plates, thereby preventing lateral movement of the hip rafter and intersecting walls and thereby preventing seismic damage to a building.

14. The connector of claim 8 wherein said right angle bend bending said front face so the right side and left side are generally perpendicular and facing toward each other, thereby forming a valley clip.

15. The connector of claim 14 wherein said valley clip having attaching means to the wall and underlying top plate, underneath and to either side of a valley rafter of a house, whereby said left side and said right side are attached to intersecting and perpendicular structural members.

16. The connector of claim 14 wherein an upper part of said threaded rods adapted for attachment to a roof and a lower part adapted for insertion into each said tunnel when said connector is attached to the intersecting walls below a valley rafter.

17. The connector of claim 14 wherein said threaded rods adapted for fastening tightly to each said tunnel, thereby securing said valley rafter to said intersecting walls and thereby helping prevent uplift of the roof which occurs during strong winds.

18. The connector of claim 14 wherein said right side and said left side having predetermined area and a plurality of nail holes for attachment to the intersecting walls and underlying, intersecting top plates, thereby preventing lateral movement of the valley rafter and intersecting walls and thereby preventing seismic damage to a building.

* * * * *